US007234316B2

(12) United States Patent
Tien

(10) Patent No.: US 7,234,316 B2
(45) Date of Patent: Jun. 26, 2007

(54) MODULARIZED HIGH EFFICIENCY COOLING DEVICE IN A COOLING MECHANISM

(75) Inventor: Chang-Wen Tien, Hsin Chu Hsien (TW)

(73) Assignee: Taiwan Fluorescent Lamp Co., Ltd., Taipei (TW)

( * ) Notice: Subject to any disclaimer, the term of this patent is extended or adjusted under 35 U.S.C. 154(b) by 242 days.

(21) Appl. No.: 10/922,900

(22) Filed: Aug. 23, 2004

(65) Prior Publication Data

US 2006/0037340 A1 Feb. 23, 2006

(51) Int. Cl.
*F28D 5/00* (2006.01)

(52) U.S. Cl. ..... 62/305; 62/506; 62/507

(58) Field of Classification Search ..... 62/126, 62/129, 183, 279, 280, 305, 506, 507, 181, 62/185

See application file for complete search history.

(56) References Cited

U.S. PATENT DOCUMENTS 3,908,393 A * 9/1975 Eubank ..... 62/305
4,404,814 A * 9/1983 Beasley et al. ..... 62/171
5,113,668 A * 5/1992 Wachs et al. ..... 62/305
6,298,809 B1 * 10/2001 Boggs ..... 123/41.15
6,318,108 B1 * 11/2001 Holstein et al. ..... 62/279
6,338,256 B1 * 1/2002 Tien ..... 62/305
6,425,253 B1 * 7/2002 Gale et al. ..... 62/129
6,463,751 B1 * 10/2002 Teller ..... 62/305
6,658,872 B1 * 12/2003 James ..... 62/171
6,761,039 B1 * 7/2004 Gray ..... 62/279
6,892,552 B2 * 5/2005 Richman et al. ..... 62/305
6,938,434 B1 * 9/2005 Fair ..... 62/309

FOREIGN PATENT DOCUMENTS

TW 450348 8/2001

* cited by examiner

*Primary Examiner*—Mohammad M. Ali
(74) *Attorney, Agent, or Firm*—Troxell Law Office, PLLC

(57) ABSTRACT

A modularized high efficiency cooling device in a cooling mechanism, which includes at least one exchanger, at least one gas cooling device, at least one water cooling unit, at least one chiller unit, at least one chiller pump and at least one pair of copper tube. The cooling device adopts modularized design so that it can be assembled to form different units according to consumer demands and has an effect of frequency conversion. The assembled unit can be installed in different places. One machine of the cooling device can be maintained individually as well as the other machines of the cooling device that are in use normally. This reduces maintenance fees and is convenient.

6 Claims, 5 Drawing Sheets

MODULARIZED HIGH EFFICIENCY COOLING DEVICE IN A COOLING MECHANISM

BACKGROUND OF THE INVENTION

1. Field of the Invention

The present invention relates to a modularized high efficiency cooling device in a cooling mechanism, and especially to a modularized high efficiency cooling device in a cooling mechanism which is especially used in cooling mechanisms, such as indoor blowers or air conditioners, using water cooling and gas cooling methods to exchange hot air for cooler air to lower power consumption.

2. Description of Related Art

FIG. 1 shows a conventional cooling device relative to the present invention (shown in TW 450,348). The cooling device is used in cooling mechanisms, such as air conditioners, refrigerators, cold storage devices, or other devices for reducing temperature. The cooling device 9 comprises a heat exchanger 91, a gas cooling unit 92, a water cooling unit 93 and a water circulation unit 94, wherein the heat exchanger 91 is composed of a plurality of heat dissipating fins 911 and refrigerant tubes 912 which wind around these heat dissipating fins 911. The refrigerant tubes 912 are connected to an air compressor 913 and an evaporator (not shown) forming a refrigerant circular system. The refrigerant tubes 912 are filled with heat transferring dielectric refrigerant. The heat of the refrigerant is then absorbed by the evaporator becoming a gas refrigerant, which is then driven by the air compressor 913 and circularly flows. It then enters the heat exchange unit 91. Whereby, the heat of the refrigerant is released as so to decrease the temperature thereof so as to be condensed to become liquid refrigerant.

The gas cooling unit 92 has a heat dissipating fan 921 so that the air flow blows laterally and outwards reducing the temperature around each heat dissipating fin 911 of the heat exchanger 91 by exchanging heat with the refrigerant tubes 912.

The water cooling unit 93 is installed in the heat exchanger 91 and comprises at least one centrifugal spray disk 93 driven by a dynamic device 931 and a water supply tube 933 for supplying cooling water to the spray disk 932. The cooling water output from the water supply tube 933 spays to the heat exchanger 91 by rotation of the spay disk 932, and then flows downwards along the ladder-shaped heat dissipating fins 911 to reduce temperature line by line. The water circulation unit 94 collects the wasted cooling water after cooling the heat exchanger 91 and supplies them to the water supply tube 933.

However, although the conventional cooling device has a high cooling efficiency and low power consumption, its specification is fixed. So that different kinds of mechanisms must be manufactured if it is needed to provide different specifications, this results in inconvenient manufacture and high manufacturing costs.

Furthermore, when the central air conditioner requires maintenance, it is very costly, and the whole device must be shut down. This also causes inconvenience.

Therefore, a cooling device which can solve the above problems is desired.

SUMMARY OF THE INVENTION

A main object of the present invention is to provide a modularized high efficiency cooling device in a cooling mechanism which can solve the problem that the conventional large central air conditioner cannot be modularized, and can be assembled to form different units having different tonnages according to the demand, and has an effect of frequency conversion. The assembled unit can be installed in different places and be assembled simply and easily, at the same time the manufacturing cost is also lower.

Another object of the present invention is to provide a modularized high efficiency cooling device in a cooling mechanism. One machine of the cooling device can be maintained individually while the other machines of the cooling device are in use normally. This saves on maintenance fees and is convenient.

Further another object of the present invention is to provide a modularized high efficiency cooling device in a cooling mechanism utilizing a water cooling method and a gas cooling method to get a better cooling effect. When (If?) water is unavailable, the system can be switched over to use a gas cooling method.

To achieve the above objectives, a modularized high efficiency cooling device in a mechanism of the present invention is provided. The cooling device comprises at least one heat exchanger, at least one gas cooling unit formed on one side of the heat exchanger, at least one water cooling unit formed on one side of the heat exchanger, at least one chiller unit, at least one pair of copper tubes connected between the heat exchanger and the chiller unit, and at least one chiller pumps connected to the chiller unit through a pipe.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

DETAILED DESCRIPTION OF THE INVENTION

Figure 1:
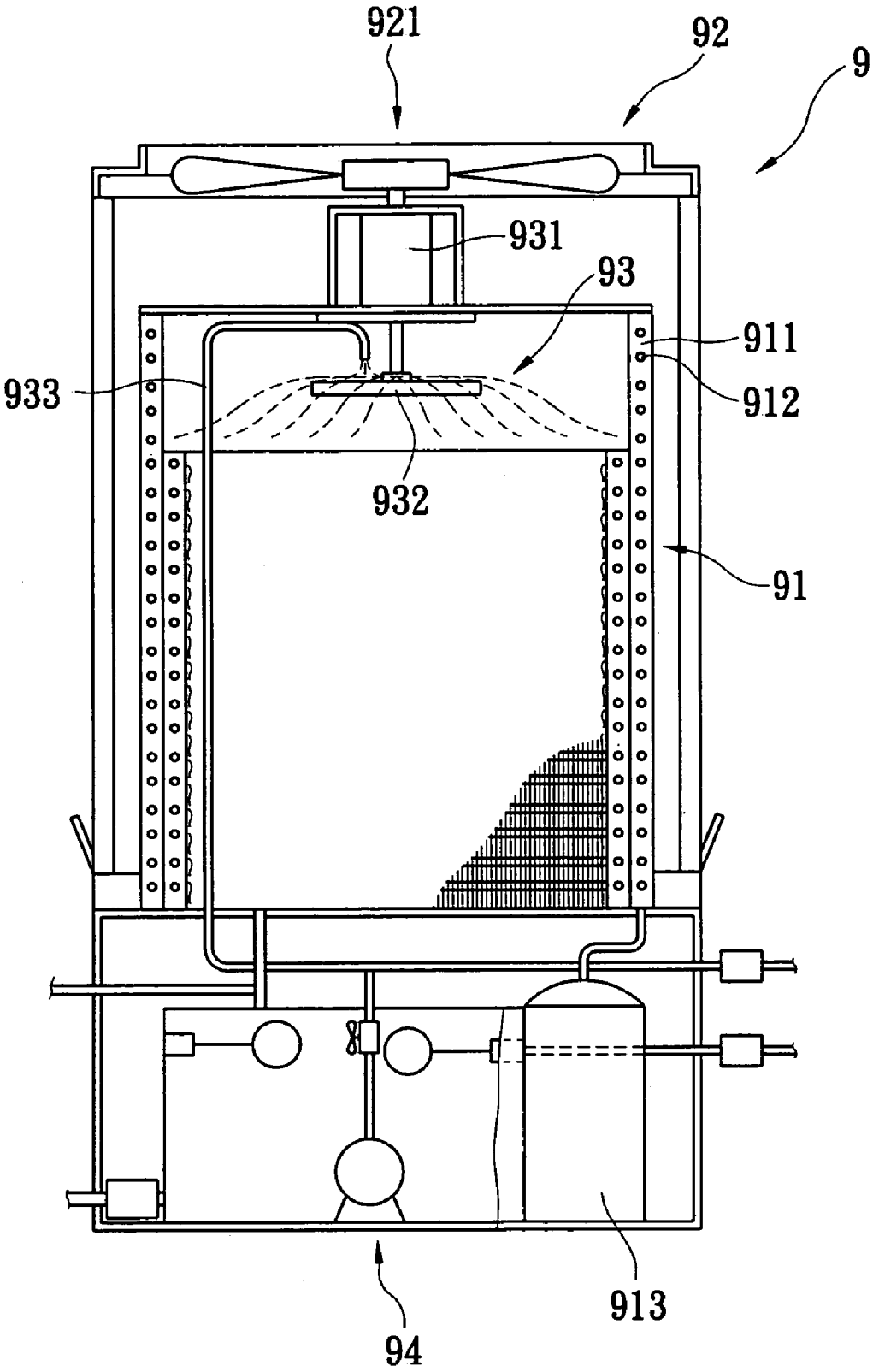
FIG. 1 is a plane view of a conventional cooling device.
Figure 2:
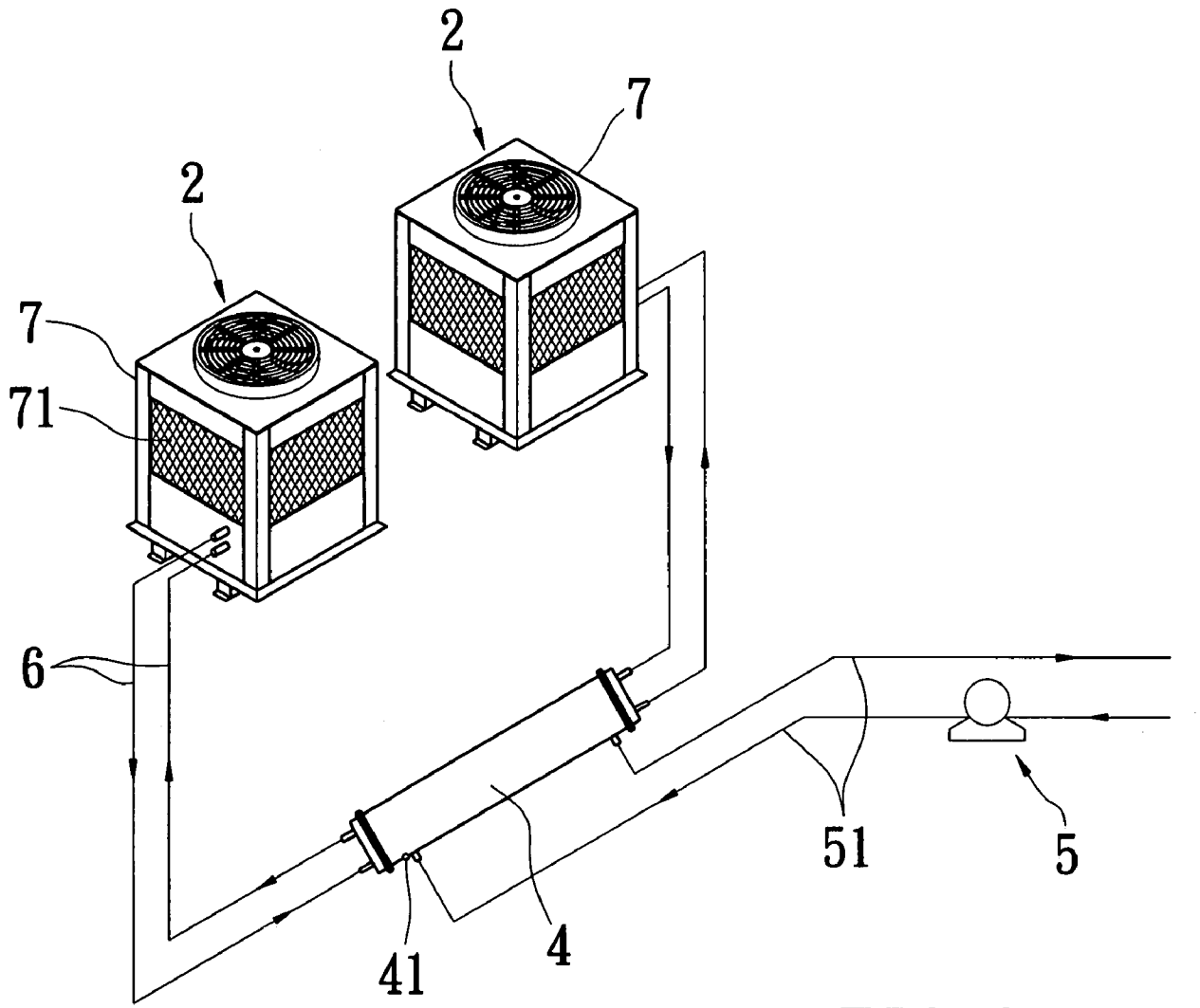
FIG. 2 a schematic, perspective view of a cooling device of the first embodiment of the present invention.
Figure 3:
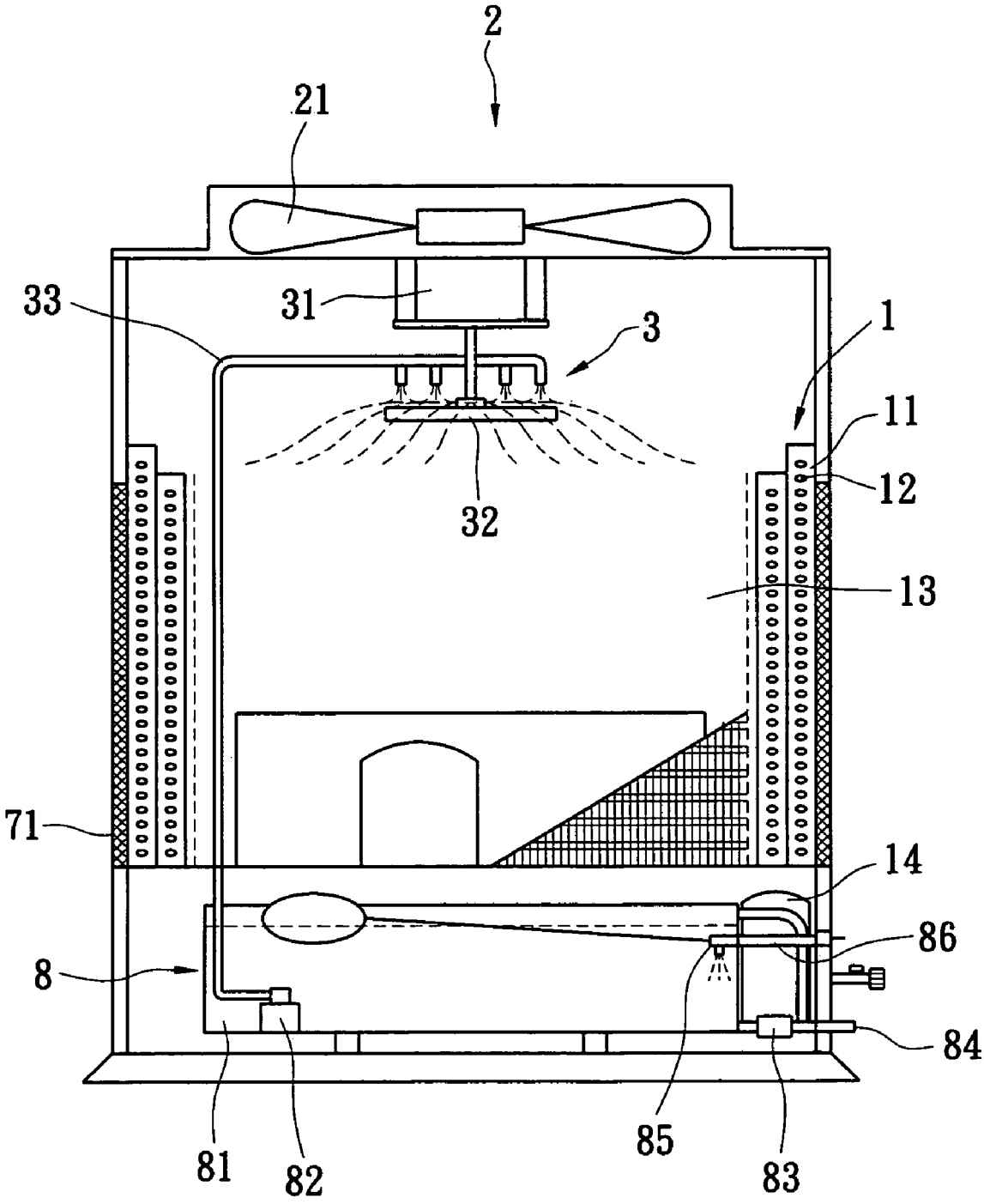
FIG. 3 is a plan view of a single machine of the cooling device of FIG. 2.
Figure 4:
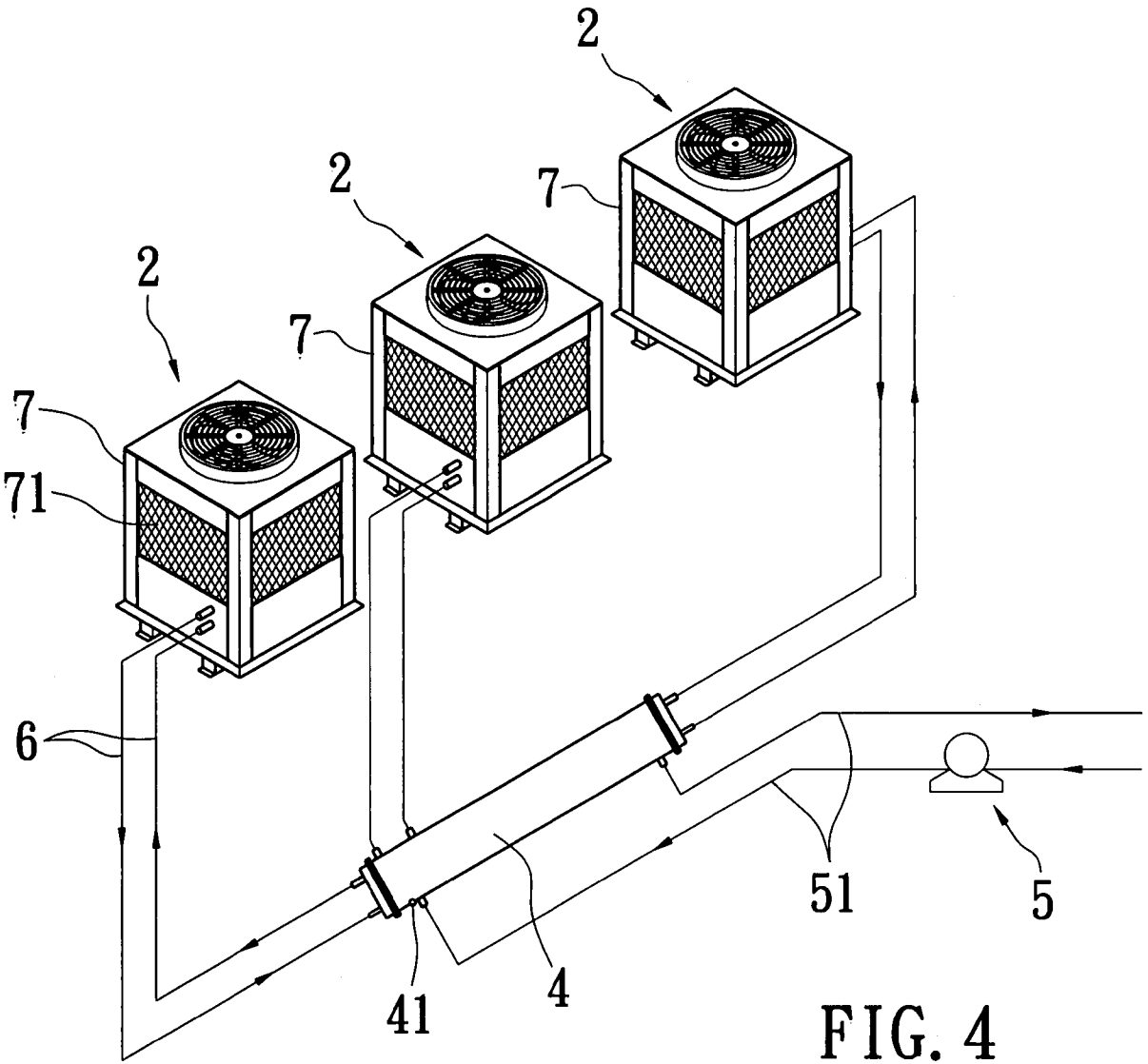
FIG. 4 a schematic, perspective view of a cooling device of the second embodiment of the present invention.
Figure 5:
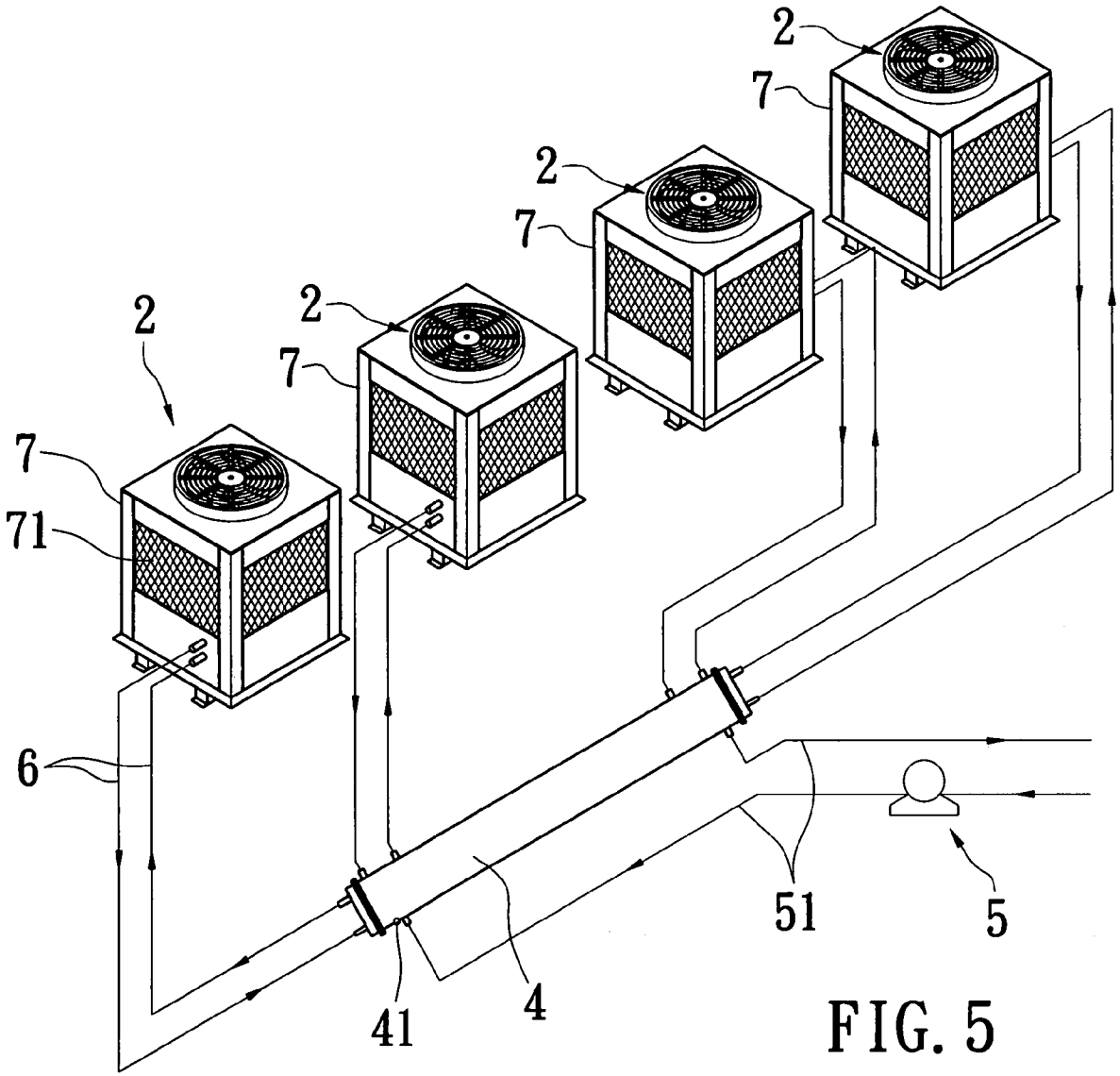
FIG. 5 is a schematic, perspective view of a cooling device of the third embodiment of the present invention.

Referring to FIGS. 2–3, the present invention provides a modularized high efficiency cooling device in a cooling mechanism, and especially provides a cooling device adopting a modularized design and being assembled according to consumer needs. The cooling device comprises at least one heat exchanger 1, at least one gas cooling unit 2, at least one water-cooling unit 3, at least one chiller unit 4, at least one chiller pump 5 and at least one copper tube 6. The present embodiment discloses a two-unit design (showing in FIG. 2), a three-unit design (shown in FIG. 4), a four-unit design (shown in FIG. 5), or another multi-unit design.

Each heat exchanger 1, each gas cooling unit 2 and each water cooling unit 3 are installed in a shield 7 to assemble a cooling unit, wherein the heat exchanger 1 is an upright round frame composed of a plurality of heat dissipating fins densely arranged and a refrigerant tube 12 winding around the heat dissipating fins horizontally and continuously. The round frame is formed with a hollow chamber 13. A plurality of heat dissipating holes corresponding to the plurality of heat exchangers 1 forms in the shield 7. The refrigerant tube 12 of the heat exchangers 1 is connected to a compressor 14, and assembles (forms?) a refrigerant circulation system with the copper tube 6 and the chiller unit 4. Heat transferring dielectric refrigerant is filled in the refrigerant tube 12, and the heat of the refrigerant is absorbed by the chiller unit 4 to become gas refrigerant, which is then driven, circulates and then enters into the heat exchanger 1. Whereby, the gas refrigerant is released so as to decrease the temperature thereof and is condensed to become liquid refrigerant.

The gas cooling unit 2 is installed above a hollow chamber 13 of the heat exchanger 1. The gas cooling unit 2 comprises a heat dissipating fan 21, thereby the air flow blows laterally and outwards to reduce the temperature around heat dissipating fins 11 of the heat exchanger 1 by exchanging heat with the refrigerant tube 12.

The water cooling unit 3 is installed above the hollow chamber 13 of the heat exchanger 1 and comprises at least one level acentric spray disk 32 driven by a dynamical device 31 having a motor and a water supply pipe 33 supplying cooling water to the spray disk 32. The spray disk 32 and the heat dissipating fan 21 are driven by the same dynamical device 31, or are driven by two dynamical devices 31 respectively, but the spray disk 32, the heat dissipating fan 21 and the dynamical devices 31 driving them are preferred to formed coaxially, and the spray disk 32 can be set one or more.

When the cooling water output from the water supply pipe 33 falls to the spray disk 32 rotating at a high speed, the cooling water sprays all over to form an inertial whirlpool. Next the inertial whirlpool sprays uniformly to the heat dissipating fins 11 and the refrigerant tube 12 which are arranged on the periphery due to the strong blowing of the heat dissipating fan 21. Next the cooling water flows downwards along the heat dissipating fins 11 so that the cooling water can sufficiently and completely contact the heat dissipating fins 11. Therefore, the cooling water may uniformly and rapidly absorb and exhaust the cooling heat of the refrigerant so that the temperature decreases quickly.

The bottom of the heat exchanger 1 is installed with a water circulation unit 8. The water circulation unit 8 comprises a water box 81 for collecting cooling water. The water box 81 is installed with a water pump 82 therein, the water pump 82 is connected to another end of the water supply pipe 33 to guide and cooling water in the water box 81 to be returned back to the water supply pipe 33. Besides, a water-draining pipe 84 having a water-draining solenoid valve 83 connected near the bottom of the water box 81. When the water draining solenoid valve 83 is opened, the cooling water within the water box 81 is drained. Furthermore, the water box 81 is connected with a water infall pipe 86 having a float ball switch. The opening or closing of the water infall pipe 86 can be controlled by the float ball switch 85, to control the water supply automatically.

The chiller unit 4 is a heat exchanger which specification varies with the quantity of the assembled unit. The chiller unit 4 is connected to the refrigerant tube 12 of the heat exchanger 1 by a copper tube 6 so as to transfer the cooling refrigerant being released to decrease the temperature thereof by the heat exchanger 1 to be condensed to liquid refrigerant, to the chiller unit 4, so as to cool the water from the chiller pump 5. The liquid refrigerant becomes gas refrigerant after exchanging heat, then the gas refrigerant is driven by the compressor 14 circularly. It then enters the heat exchanger 1 to become liquid refrigerant after exchanging heat, forming the refrigerant circulation system. Besides, a temperature-sensing rod 41 is formed on the chiller unit 4 for detecting the temperature of the chiller unit 4.

The chiller pump 5 is connected to the chiller unit 4 by the pipe 51 to pump the high temperature circulation water from the indoor blowers or air conditioners to the chiller unit 4. The high temperature circulation water is cooled in the chiller unit 4 is then transferred to the indoor blowers and the air conditioners to reduce the temperature. Thus, the modularized high efficiency cooling device in a mechanism of the present invention is provided.

Each unit mentioned above forms a ice water temperature switch (not shown) individually to set a predetermined temperature individually. For example, when the temperature of the ice water reaches 13° C., one unit stops working. When the temperature of the ice water reaches 11° C., two units stop working. When the temperature of the ice water reaches 9° C., three units stop working. When the temperature of the ice water reaches 7° C., four units stop working but the chiller unit 4 still works normally.

The cooling device of the present invention adopts modularized design so that it can solve the problem that the conventional large central air conditioner cannot be modularized. It can be assembled to form different units having different tonnages (for example 5 to 20 tons) according to the demand and has an effect of frequency conversion. The assembled unit can be installed in different places and be assembled simply and easily. This allows for the lowering of manufacturing costs.

Furthermore, the present invention provides a modularized cooling device so that one machine of the cooling device can be maintained individually as well as other cooling devices that are in use normally. This lowers maintaince fees and is more convenient.

The present invention utilizes water cooling and gas cooling methods to reduce temperature to improve cooling. If water is unavailable, the cooling device of the present invention also works with a gas cooling method.

Each unit of the present invention can set a predetermined temperature individually. When the temperature of the ice water is under the predetermined temperature, the unit stops working, thereby the ice water unit is adjusted automatically according to the condition of the indoor blowers or the air conditioners. So that the temperature is controlled more precisely than that of a central air conditioner, the controlling range exceeds that of the ice water machine and will not produce a big current because of frequent starting of the machine. As such it saves power and is safe.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modularized high efficiency cooling system in a mechanism, comprising:

at least one heat exchanger;

at least one gas cooling unit formed on one side of the heat exchanger;

at least one water cooling unit formed on one side of the heat exchanger;

at least one chiller unit, having a temperature sensing rod thereof;

at least one pair of copper tubes connected between the heat exchanger and the chiller unit; and at least one chiller pump connected to the chiller unit through a pipe;

wherein each heat exchanger, each gas cooling unit, and each water cooling unit are installed in a shield respectively to assemble a cooling unit;

wherein the chiller unit is disposed outside of the cooling unit.

2. The modularized high efficiency cooling system in a cooling mechanism as claimed in claim 1, wherein the heat exchanger is composed of a plurality of heat dissipating fins and a refrigerant tube winding around the heat dissipating fins continuously, the refrigerant tube of the heat exchanger being connected to a compressor, the refrigerant tube being filled with heat transferring dielectric refrigerant.

3. The modularized high efficiency cooling system in a cooling mechanism as claimed in claim 1, wherein the gas cooling unit comprises a heat dissipating fan and a dynamical device driving the heat dissipating fan.

4. The modularized high efficiency cooling system in a cooling mechanism as claimed in claim 1, wherein the water cooling unit comprises at least one spray disk, a dynamical device driving the spray disk, and a water supply pipe supplying cooling water to the spray disk.

5. The modularized high efficiency cooling system in a cooling mechanism as claimed in claim 4, wherein the heat exchanger forms a water circulation unit on a bottom thereof, the water circulation unit comprising a water box collecting cooling water, the water box forming a water pump connecting to one end of the water supply pipe.

6. The modularized high efficiency cooling system in a cooling mechanism as claimed in claim 5, wherein the water box is connected to a water draining pipe having a water draining solenoid valve and a water infall pipe having a float ball switch.

* * * * *